United States Patent [19]

Jarrett

[11] Patent Number: 4,462,370

[45] Date of Patent: Jul. 31, 1984

[54] FUEL INJECTION PUMPING APPARATUS

[75] Inventor: Boaz A. Jarrett, London, England

[73] Assignee: Lucas Industries Limited, Birmingham, England

[21] Appl. No.: 331,823

[22] Filed: Dec. 17, 1981

[30] Foreign Application Priority Data

Dec. 31, 1980 [GB] United Kingdom ..... 8041546

[51] Int. Cl.[3] ..... F02M 39/00

[52] U.S. Cl. ..... 123/450; 123/387; 123/502; 417/462

[58] Field of Search ..... 123/450, 502, 387, 451, 123/501, 500; 417/462, 253, 252

[56] References Cited

U.S. PATENT DOCUMENTS

| | | | |
|---|---|---|---|
| 3,485,225 | 12/1969 | Bailey | 123/450 |
| 3,628,889 | 12/1971 | Kobayashi | 123/502 |
| 4,292,012 | 9/1981 | Brotherston | 417/462 |

*Primary Examiner*—Charles J. Myhre
*Assistant Examiner*—Carl Stuart Miller

[57] ABSTRACT

A fuel injection pumping apparatus of the axially slidable rotary distributor type includes a cup shaped member mounted on a drive shaft and a distributor member which as a bore containing pumping plungers. The outward movement of the plungers is controlled by a tapered surface on the interior of the cup shaped member which co-acts with complementary surfaces on cam followers, disposed between the plungers and a surrounding cam ring. The slots in the cup shaped member which accommodate the followers are of helical or like form and the distributor member is driven angularly by tongues which are secured to the distributor member and which locate in the slots. As the distributor member moves axially it is also moved angularly by the action of the helical slots so that the timing of delivery of fuel remains constant.

4 Claims, 8 Drawing Figures

FUEL INJECTION PUMPING APPARATUS

Figure 1:
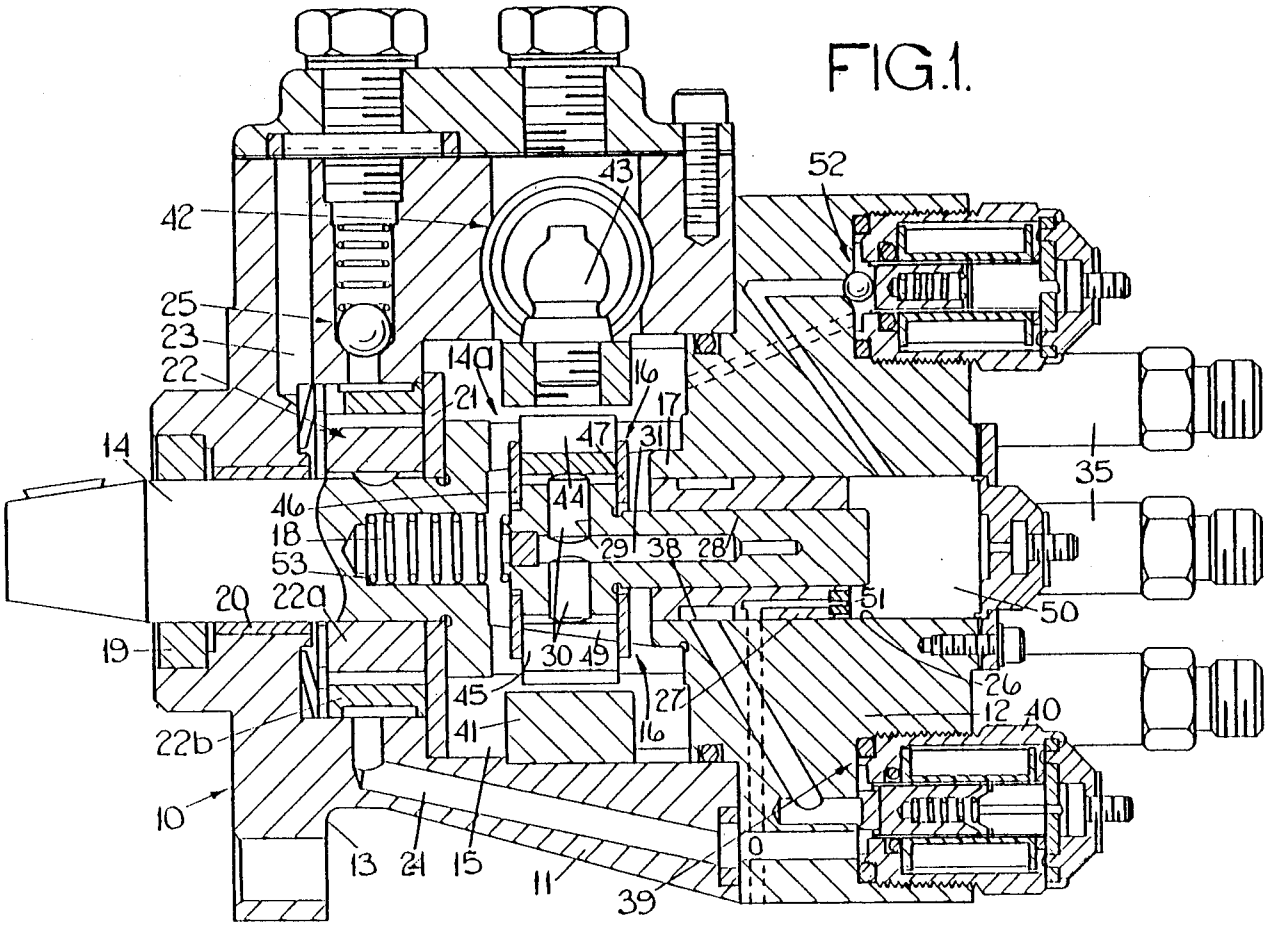

This invention relates to fuel injection pumping apparatus of the kind comprising an axially slidable rotary distributor member located in a surrounding body part and arranged in use to be rotated in timed relationship with an associated engine, a bore formed in the distributor member and a plunger slidable in said bore, a delivery passage in the distributor member for communication in turn with a plurality of outlet ports in the body part during successive inward movements of the plunger, said delivery passage communicating with said bore so that the fuel displaced by said plunger is supplied to an outlet port, a cam for imparting inward movement to said plunger as the distributor member rotates, supply means for supplying fuel to said bore to effect outward movement of the plunger and stop means for controlling the extent of outward movement of the plunger, said stop means being arranged to vary the extent of outward movement of the plunger in accordance with the axial position of the distributor member thereby to control the amount of fuel supplied by the apparatus to the engine.

An example of such an apparatus is described in U.S. Pat. No. 4,292,012. With the apparatus as described in the aforesaid specification the start of delivery of fuel depends upon the amount of fuel supplied to the bore during the previous filling period. The smaller the amount of fuel supplied to the bore the later will be the delivery of fuel to the associated engine. The cessation of fuel flow to the engine will however be substantially constant irrespective of the fuel quantity.

In order to compensate for the variation in the timing of the start of delivery of fuel it is known to provide a device for adjusting the setting of the cam within the body part. In many cases the device is responsive to both the amount of fuel supplied to the associated engine and also the speed of operation thereof.

With modern high speed diesel engines it is necessary to extend the range of adjustment of the cam in order to cater for the substantially constant delay in terms of time, between the delivery of fuel by the apparatus and the opening of the valve in the respective fuel injection nozzle to allow fuel flow to the engine. There is however a practical limit to the extent of adjustment of the cam and this is because adjustment of the cam can only be effective to control the timing of delivery of fuel providing the delivery passage is in communication with an outlet. If the cam variation is extended, the sizes of the delivery passage and outlets must be increased in order to ensure that they will be in communication whenever a plunger is moved inwardly to effect fuel delivery. The effect is therefore that there is a reduced time interval considered in terms of degrees of rotation of the distributor member, for supplying fuel to the bore.

The object of the present invention is to provide such an apparatus in a simple and convenient form.

According to the invention an apparatus of the kind specified comprises a coupling interposed between a drive shaft and the distributor member, said drive shaft in use being coupled to a rotary part of the associated engine, said coupling incorporating a helical or like peg and slot connection whereby as the distributor member is moved axially relative to the drive shaft angular movement of the distributor member relative to the drive shaft will occur to maintain the timing of delivery of fuel by the apparatus substantially constant.

In the accompanying drawings

Figure 2:
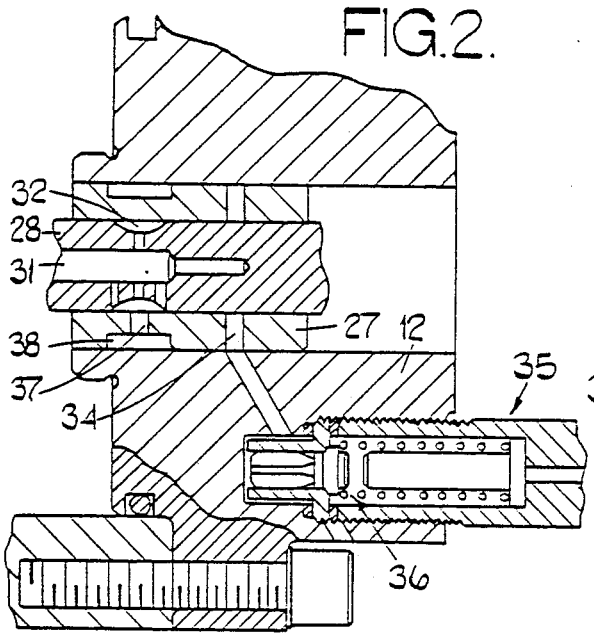
Figure 3:
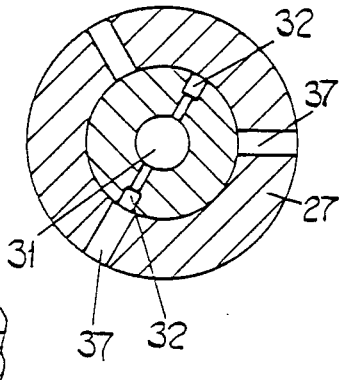
Figure 4:
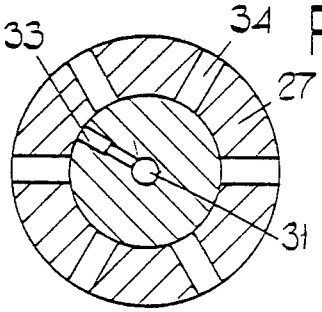
Figure 5:
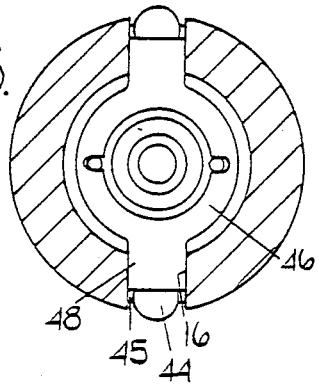
Figure 6:
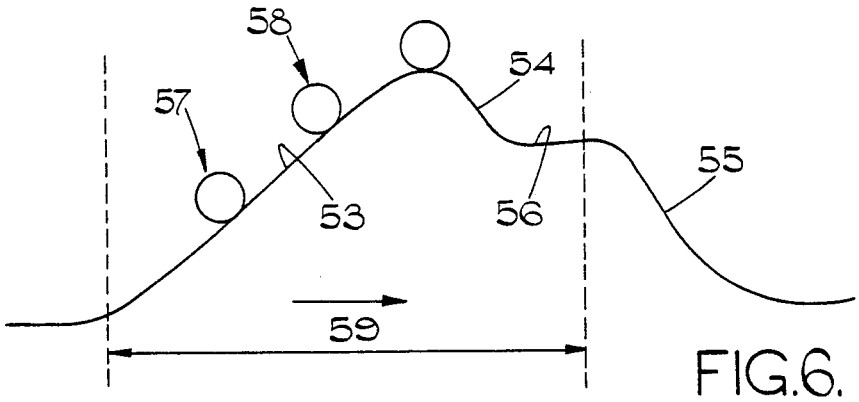
Figure 7:
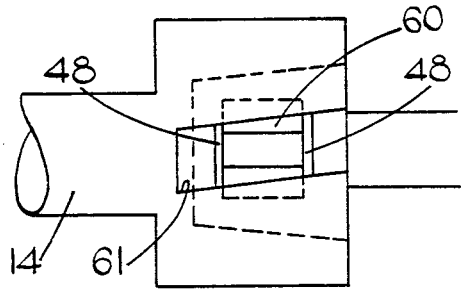
Figure 8:
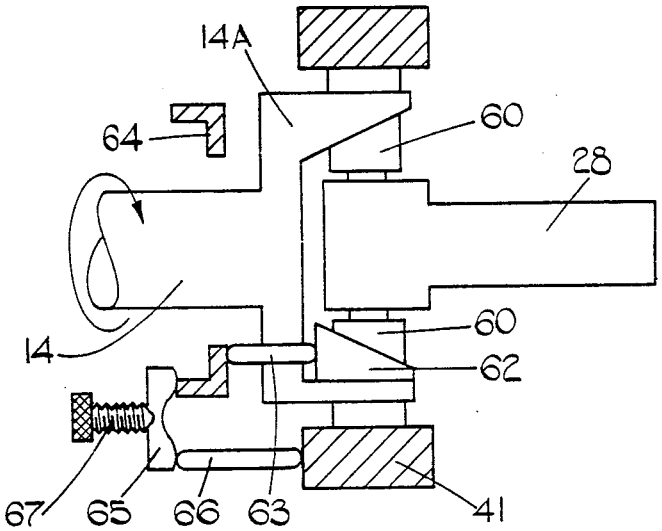

FIG. 1 is a sectional side elevation of a known form of apparatus to which the invention may be applied, FIG. 2 is a section of a part of the apparatus seen in FIG. 1 taken along a different radial plane, FIGS. 3 and 4 are sections through parts of the apparatus seen in FIGS. 1 and 2, FIG. 5 is a section through part of the apparatus seen in FIG. 1, FIG. 6 is a diagram illustrating one aspect of the operation of the apparatus of FIG. 1, FIG. 7 is a plan view of part of the apparatus seen in FIG. 1 modified in accordance with the invention and FIG. 8 shows a further modification.

Referring to FIG. 1 of the drawings, the apparatus comprises a body part generally indicated at 10 and which conveniently is formed by a generally cup-shaped portion 11, which may be formed from a light alloy the open end of which is closed by a closure portion 12, this being formed from steel. The body portion 10 is provided with apertured lugs 13 whereby in use the apparatus can be secured to the engine with which it is associated.

The body portion 11 mounts a rotary drive shaft 14 which in use is coupled to a drive member of the associated engine so that the drive shaft is rotated in synchronism with the engine. The drive shaft 14 extends into the generally cylindrical chamber 15 defined by the two body portions and has an enlarged cup shaped portion 14a within the chamber. The enlarged portion is provided with a pair of diametrically disposed slots 16. The enlarged portion of the drive shaft is hollow and at its end remote from the smaller diameter portion of the shaft the inner suface is of right cylindrical form and locates about a spigot portion 17 defined by the body portion 12. The remainder of the interior surface of the enlarged portion of the drive shaft tapers for a purpose which will be described. Moreover, the drive shaft is provided with a counter bore 18. An oil seal 19 is provided at the outer end of the body portion 10 for engagement with the drive shaft 14 and a sleeve bearing 20 supports the shaft for rotation, the shaft being given additional support by the spigot 17. The shaft is located against axial movement by a thrust surface which engages with the end surface defined between the two portions of the shaft. The thrust surface is defined by an annular plate 21 which surrounds the drive shaft and which additionally serves as an end closure for a low pressure fuel supply pump 22. The rotor 22a of the supply pump is carried by the drive shaft 14 and the rotor in turn carries vane which co-operate with an eccentrically disposed surface on a stator ring 22b which is carried within a body portion 11. The low pressure pump has a fuel inlet 23 connected to a fuel inlet in a housing secured to the body portion 11 and a fuel outlet 24. Moreover, a relief valve 25 is provided to ensure that the output pressure of the pump remains within desired limits, the relief valve being connected between the inlet and the outlet.

Formed in the body portion 12 is a cylindrical bore 26 in which is fixed a sleeve 27. The sleeve 27 accommodates an angularly and axially moveable distributor member 28 which projects into the chamber 15 and has an enlarged head portion lying within the chamber. Formed in the head portion of the distributor member is a transversely extending bore 29 in which is located a pair of pumping plungers 30. The bore 29 communicates with a blind passage 31 formed in the distributor member and which at its end within the head portion is sealed by means of a plug. As in more clearly shown in FIGS. 2, 3 and 4 the passage 31 communicates with a pair of diametrically disposed longitudinal slots 32 formed in the periphery of the distributor member and communicating with the passage 31 by means of a single or a plurality of connecting passages. The passage 31 also communicates with a delivery passage which terminates in a slot 33 formed in the periphery of the distributor member and this slot communicates in turn with a plurality of outlet ports 34 formed in the sleeve 27 and as seen in FIG. 2, the outlet ports 34 communicate with outlets 35 respectively in the body portion 12. Each outlet incorporates a conventional form of delivery valve 36. The slots 32 register in turn with inlet ports 37 formed in the sleeve 27 and communicating with a circumferential groove 38 formed in the periphery of the sleeve. The groove 38 as shown in FIG. 1, communicates with the outlet 24 of the low pressure pump 22 by way of an on/off valve 39 conveniently controlled by an electromagnetic device 40. If desired a single slot 32 may be provided with the number of inlet ports being equal to the number of outlets.

Surrounding the head portion of the distributor member 28 is an annular cam ring 41 on the internal peripheral surface of which are formed pairs of diametrically disposed cam lobes. In the particular example three pairs of lobes are provided since the apparatus is intended to supply fuel to a six cylinder engine. Moreover, the cam ring 41 is angularly movable about the axis of rotation of the distributor member by means of a fluid pressure operable device generally indicated at 42 and connected to the cam ring by way of a radially disposed peg 43. The device 42 conveniently includes a resiliently loaded piston housed within a cylinder to one end of which liquid under pressure can be supplied to act on the piston to urge the piston against the action of its resilient loading.

Positioned at the outer ends of the plungers are a pair of followers each of which comprises a roller 44 carried in a shoe 45. The followers are retained axially relative to the distributor member by a pair of side plates 46, 47 which are secured to the side faces of the head portion of the distributor member. Conveniently as shown in FIG. 5, the side plates are of annular form and have a pair of outwardly extending tongues 48, which locate in the slots 16 formed in the enlarged portion of the drive shaft, the slots 16 and tongues 48 form a coupling and to transmit rotary motion to the distributor member from the drive shaft whilst allowing relative axial movement thereof. The shoes 45 are also located within the aforesaid slots 16 and the rotary motion is transmitted to the shoes directly by the drive shaft. Moreover, the circumferential side faces of the shoes are provided with circumferentially extending projections 49 the radially outer surfaces of which are tapered to co-operate with the tapered surface formed on the internal surface of the enlarged portion of the drive shaft 14.

In use, when fuel is supplied to the bore 29, upon registration of a groove 32 with an inlet passage 37, the plungers 30 are moved outwardly by the fuel pressure and in so doing impart outward movement to the shoes 45 and the rollers 44. The outward movement is limited by the abutment of the tapered surfaces on the shoes and shaft and by moving the distributor member axially the extent of outward movement can be varied. Thus the amount of fuel supplied to the bore 29 can be controlled and this in turn determines the amount of fuel delivered through an outlet when the plungers 30 are moved inwardly by a pair of cam lobes.

The axial position of the distributor member can be varied mechanically or hydraulically. In the arrangement described the variation is achieved by varying the pressure within a chamber 50 defined by the end of the bore 26 in the body portion 12. The end of the bore 26 is closed by a closure member and fuel under pressure is supplied to the chamber 50 by way of a restricted orifice 51 carried by the sleeve 27. The orifice communicates with the outlet 24 of the pump 22. Fuel is allowed to escape from the chamber 50 so that the pressure in the chamber can be controlled, by way of an electromagnetically controlled valve 52. Moreover, the distributor member is biassed by means of a coiled compression spring 53 which is housed within the blind bore 18 formed in the drive shaft 14. The spring 53 acts between the drive shaft and the distributor member and urges the distributor member against the action of fuel under pressure in the chamber 50 which acts on the distributor member.

By varying the pressure in the chamber 50 using the valve 52 so the axial position of the distributor member can be varied and therefore the amount of fuel delivered each time the plungers move inwardly can be varied.

For a given axial setting of the distributor member and ignoring leakage, the amount of fuel delivered by the plungers will remain the same through the speed range of the associated engine and an indication of the axial setting of the distributor member, is provided by transducer means.

In FIG. 6 there is shown the profile of a cam lobe, the arrow indicating the direction of movement of the roller relative to the cam lobe when the apparatus is in operation. The cam lobe has a leading flank 53 and a trailing flank which includes a first portion 54 and a second portion 55 which are separated by a dwell portion 56. Upward movement of the roller and therefore the plunger, corresponding to inward movement, terminates at the crest of the lobe but the start of upward movement depends upon the position of the roller before it strikes the leading flank. The position of the roller indicated at 57 corresponds to maximum fuel delivery whilst that indicated at 58 constitutes a smaller or minimum delivery. It will be seen that the smaller the quantity of fuel the later will the start of delivery of fuel to the engine occur. In order to compensate for this the cam ring can be moved angularly but this requires that the angle during which the slot 33 is in communication with a port 34 must be extended, the angle being indicated at 59. If added variation of the delivery is required to cater for high speed engines then the angle during which the slot registers with a port must be further extended. In a pump for supplying fuel to a six cylinder engine this can leave insufficient time for filling the bore.

In order to overcome this problem it is proposed as shown in FIG. 7 to modify the coupling constituted by the slots 16 and tongues 48 so that as the distributor member is moved axially to vary the quantity of fuel, relative angular movement of the drive shaft and the distributor member will occur sufficient to ensure that the instant of delivery of fuel remains substantially constant.

As shown in FIG. 7, the shoes 60 together with the tongues 48 are located in helical slots 61, the shoes as in the example of FIG. 1 are fixed axially relative to the distributor member. The cam ring can still be angularly movable in accordance with speed to compensate for the aforementioned fixed timed delay between delivery of fuel by the apparatus and injection of fuel into the engine. Moreover, it may be necessary to effect some further variation of the timing of injection of fuel into the engine with speed and this can be effected by the cam adjusting mechanism.

With reference now to FIG. 8, this shows a modification in which the initial rate of fuel delivery to the associated engine can be varied in accordance with the speed at which the engine is operating.

In order to provide a variation in the initial rate of fuel delivery it is proposed that one of the plungers 30 should be moved inwardly before the other. This is achieved by allowing that one plunger to move further in the outward direction whilst fuel is being supplied to the bore 29 as compared with the other plunger. With only one plunger moving inwardly and assuming both plungers have the same diameter, the rate of delivery of fuel will be half that obtained when both plungers are moved inwardly.

In order to adjust the extent of outward movement of the one plunger (the lower plunger in FIG. 8) a member 62 is provided which is slidable in a helical guide and which defines the inclined surfaces with which engage the inclined surfaces on the shoe 60. The position of the member 62 is determined by a push rod 63 slidable in an aperture in the base of the cup shaped member. An axially movable ring 64 is located in the housing of the apparatus and its position is determined by a rocker member 65 which is engaged by one end of a further push rod 66 the other end of which is in engagement with a cam surface formed on the side face of the cam ring 41. Since the angular position of the cam 41 is dependant only upon the speed of the associated engine so also is the axial position of the ring 64 and hence the member 62. Hence the quantity of fuel which is supplied at the reduced rate is made to vary in accordance with the speed of the associated engine. For adjustment purposes the pivot 67 about which the rocker member is mounted is adjustable. It will be understood that for a fixed axial setting of the distributor member if the axial position of the member 62 is altered, the total amount of fuel supplied by the apparatus will also alter. This can be corrected by adjusting the axial position of the distributor member.

As described when one plunger is moved inwardly the forces acting on the cup shaped member 14A and also the cam ring 41 will be unbalanced and this could lead to excessive wear of the drive shaft and the bore in which it is located and also the cam ring and the surrounding body. In a practical construction therefore two pairs of plungers would be provided together with the associated followers and members 62. The members 62 would be diametrically disposed so that the two plungers which are moved inwardly before the other two plungers would also be diametrically disposed. Hence the forces acting on the cup shaped member and the cam ring would balance each other.

I claim:

1. A fuel injection pumping apparatus comprising an axially slidable rotary distributor member located in a surrounding body part and arranged in use to be rotated in timed relationship with an associated engine, a bore formed in the distributor member and a plunger slidable in said bore, a delivery passage in the distributor member for communication in turn with a plurality of outlet ports in the body part during successive inward movements of the plunger, said delivery passage communicating with said bore so that the fuel displaced by said plunger is supplied to an outlet port, a cam for imparting inward movement to said plunger as the distributor member rotates, supply means for supplying fuel to said bore to effect outward movement of the plunger, speed responsive means for varying the setting of the cam to provide timing adjustment stop means for controlling the extent of outward movement of the plunger said stop means being arranged to vary the extent of outward movement of the plunger in accordance with the axial position of the distributor member thereby to control the amount of fuel supplied by the apparatus to the engine, a coupling interposed between a drive shaft and the distributor member, said drive shaft in use being coupled to a rotary part of the associated engine, said coupling incorporating a helical peg and slot connection whereby as the distributor member is moved axially relative to the drive shaft angular movement of the distributor member relative to the drive shaft will occur to maintain the timing of delivery of fuel by the apparatus substantially constant.

2. An apparatus according to claim 1 in which said coupling comprises a cup shaped member to said drive shaft, said cup shaped member surrounding the part of the distributor member in which said bore is formed, said slot being formed in said cup shaped member, a cam follower located in said slot, a tapered surface defined on the internal peripheral surface of said cup shaped member, a cam follower located in said slot, surfaces defined on said cam follower for co-operation with the internal surface of said cup shaped member to limit the extent of outward movement of said cam follower and the plunger, and tongues located in said slot, said tongues extending from the distributor member and being disposed at the opposite ends of said cam followers.

3. An apparatus according to claim 1 including a further plunger located in a further bore, an axially movable member carried by said cup shaped member and slidable within a helical or like slot therein, a further cam follower associated with said further plunger said axially movable member defining a surface for engagement by surfaces on said further cam follower to limit the outward movement of said further plunger and means for adjusting the axial setting of said axially movable member.

4. An apparatus according to claim 3 in which the means for adjusting the axial setting of said axially movable member includes a linkage operated by a cam surface defined on said cam ring.

* * * * *